US007063212B2

(12) United States Patent
Ordonez

(10) Patent No.: US 7,063,212 B2
(45) Date of Patent: Jun. 20, 2006

(54) MULTIPLE SEAL STORAGE AND TRANSPORT CONTAINER

(75) Inventor: José L. Ordonez, Canyon Country, CA (US)

(73) Assignee: Bill Thomas Associates, Inc., Valencia, CA (US)

( * ) Notice: Subject to any disclaimer, the term of this patent is extended or adjusted under 35 U.S.C. 154(b) by 595 days.

(21) Appl. No.: 10/247,407

(22) Filed: Sep. 19, 2002

(65) Prior Publication Data

US 2004/0055922 A1 Mar. 25, 2004

(51) Int. Cl.
*B65D 85/54* (2006.01)

(52) U.S. Cl. ..... 206/703; 206/524.5; 220/849

(58) Field of Classification Search ..... 220/806, 220/849, 810, 745.6, 378; 206/524.5, 703, 206/811

See application file for complete search history.

(56) References Cited

U.S. PATENT DOCUMENTS

| | | | | |
|---|---|---|---|---|
| 1,283,803 | A | | 11/1918 | Lorenz |
| 2,349,587 | A | | 5/1941 | Brand |
| 2,604,507 | A | | 6/1952 | Tyson |
| 2,907,492 | A | | 10/1959 | Robertson |
| 3,298,870 | A | | 1/1967 | Sabatino |
| 3,428,208 | A | | 2/1969 | Kosar |
| 3,447,711 | A | | 6/1969 | Bozek |
| 3,547,305 | A | | 12/1970 | Khoury |
| 3,791,875 | A | * | 2/1974 | Koehler ..... 429/97 |
| 4,044,941 | A | | 8/1977 | Knudsen |
| 4,290,536 | A | | 9/1981 | Morel |
| 4,298,204 | A | | 11/1981 | Jinkins |
| 3,215,304 | A | | 11/1985 | Rohe |
| 4,689,099 | A | | 8/1987 | Ito et al. |
| 4,736,889 | A | | 4/1988 | Horvath |
| 4,775,076 | A | | 10/1988 | Horvath |
| 4,820,071 | A | | 4/1989 | Steinfield et al. |
| 4,913,307 | A | | 4/1990 | Takata et al. |
| 5,582,884 | A | | 12/1996 | Ball et al. |
| 5,621,189 | A | | 4/1997 | Dodds |
| 5,914,159 | A | * | 6/1999 | Kato ..... 428/34.1 |
| 6,202,887 | B1 | | 3/2001 | Petit |
| 6,401,957 | B1 | | 6/2002 | Przytulla |
| 6,619,192 | B1 | * | 9/2003 | Lee ..... 99/422 |

* cited by examiner

*Primary Examiner*—Jacob K. Ackun, Jr.
(74) *Attorney, Agent, or Firm*—Tangent Law Group; Eric J. Weierstall

(57) ABSTRACT

A container suitable for storing and transporting hazardous materials such as alkali wet cell batteries in an aviation environment includes a container body and a hinged lid made of cross linked polyethylene, latches, and a triple tongue-in-groove seal around the rim of the container opening. The triple tongue-in-groove seal includes two smaller tongue-in-groove seals with a larger tongue-in-groove seal disposed therebetween. The larger tongue-in-groove structure provides structural strength to help prevent the lid from skewing when the container suffers stress such as an impact at a corner, and also helps to guide the lid and base into proper alignment when the lid is being closed. The smaller tongue-in-groove seals provide double redundant sealing to help contain hazardous materials inside the container without making the rim of the container excessively wide.

24 Claims, 4 Drawing Sheets

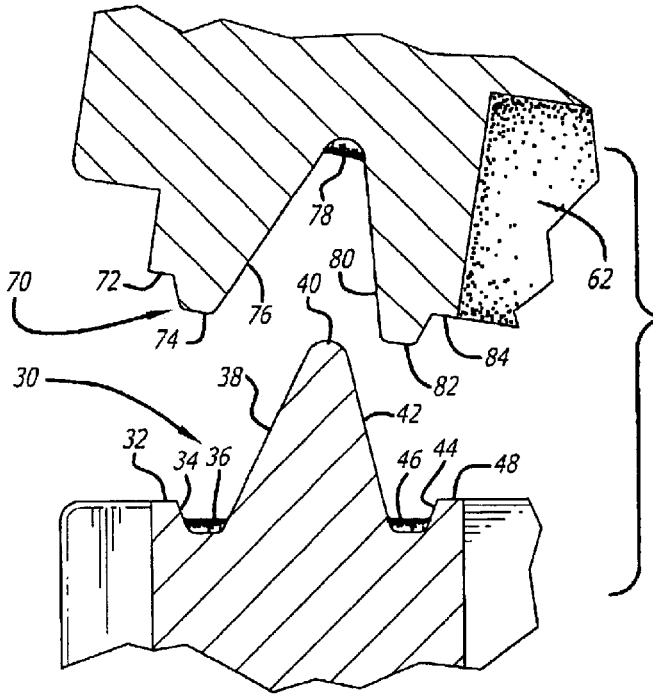
FIG. 3
FIG. 4
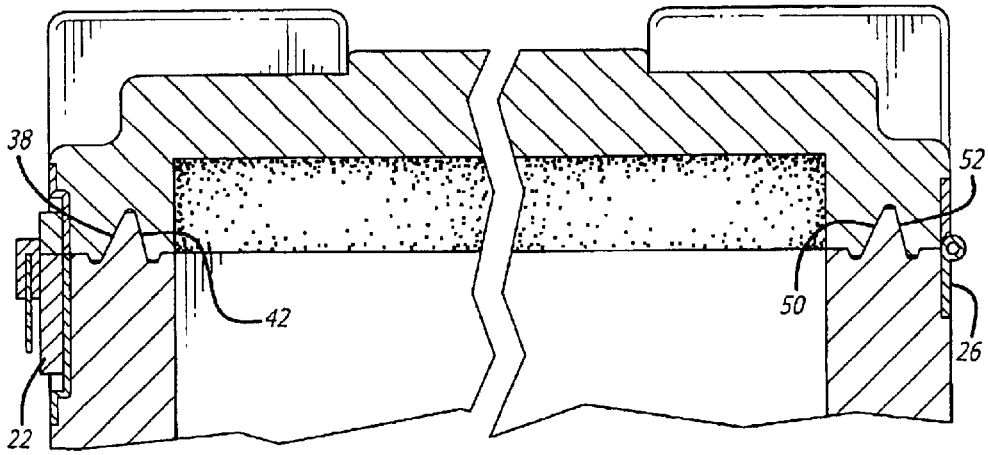

MULTIPLE SEAL STORAGE AND TRANSPORT CONTAINER

RELATED APPLICATIONS

None.

FIELD OF THE INVENTION

The present invention relates to the field of storage containers, and more particularly to the field of storage and transport containers for hazardous materials.

BACKGROUND OF THE INVENTION

The long term health hazards to humans posed by exposure to various materials has been increasingly recognized. Thus, there is an increasingly recognized need for effective containers for storing and transporting hazardous materials ("haz-mat").

Additionally, special care must be taken when transporting hazardous materials on airplanes due to the particularly high threat to life and property that corrosive, flammable, or otherwise dangerous materials pose aboard airplanes. For example, improper storage and transport of oxygen generating canisters was blamed for the 1996 crash of ValuJet flight 592 in the Florida everglades in which more than 100 people were killed.

Electrical storage batteries comprise one category of hazardous materials which are sometimes transported by airplane. A number of incidents have been reported in which electrical storage batteries being transported as freight or within passengers' luggage have apparently short circuited after an electrical conductor inadvertently placed on or near the battery terminals created an electrical path between the terminals causing smoking, smoldering, and even a fire in one reported instance. Engineering specifications have been promulgated for containers for transporting electrical storage batteries by airplane. United Nations Recommendations on the Transport of Dangerous Goods—Model Regulations (UN) 2795 defines a category of wet alkali storage batteries containing corrosive electrolyte. Title 49 of the Code of Federal Regulations (CFR), sections 178.603, 178.606, and 178.608 define performance parameters for drop, stack, and vibration, respectively, for air containers of certain types of hazardous materials.

In order to meet the safety requirements for shipping alkali- or acid-containing wet batteries via airplane, a common method is to place the battery in a one or more corrosive resistant sealable plastic bags, and then place the bagged battery inside a wooden shipping crate, usually with additional padding or containment. There is a need for improved storage containers that are capable of passing various transportation standards, including the aforementioned CFR sections for transporting various materials including UN 2795 wet alkali electrical storage batteries, but yet is lightweight and convenient to use.

SUMMARY OF THE INVENTION

A storage and shipping container is disclosed herein which is lightweight, reusable, stackable, and which is particularly well suited to the storage and transportation including air transportation of materials comprising or containing hazardous liquids, including UN 2795 wet alkali storage batteries.

The container is made of cross linked polyethylene, and has a unique triple tongue-in-groove seal where the lid meets the base of the container. A first relatively large tongue extends around the rim of the base. Also extending around the rim of the base on either side of the first tongue and adjacent to it are significantly smaller grooves. On the rim of the lid are a first groove and two smaller tongues. The first and large tongue on the base fits into the first and large groove on the lid, and the second and third smaller tongues on the lid fit into the second and third smaller grooves on the base. In cross section, the seal presents three interlocking teeth, with the inner tooth being larger than the other two. All three of the grooves include sealing gaskets. The lid and base are hinged together, and the lid is tightened down onto the lid by a cinching type latch such as a butterfly latch. Closed cell foam inserts or similar shaped inserts are secured into the base and the lid to hold the battery firmly and snugly inside the box. Preferably the battery is placed inside a sealable corrosive resistant bag such as a sealable plastic bag, placed inside the base, and the lid is shut and latched down onto the base. The large tongue-in-groove seal provides high resistance to inadvertent opening or shearing of the box when dropped, especially when the box is dropped onto a corner which is part of the drop testing according to the applicable standards. The additional two tongue-in-groove seals provide redundant sealing to prevent any leakage of hazardous liquid such as acid or alkali from the battery, or from any other product which may be carried inside the box. Those two seals, while providing redundancy, are small enough so as to not require an unduly wide rim at the interface between the container base and lid.

Additionally, the larger tongue has an asymmetrical cross section. One side of the tongue forms a larger angle with respect to the vertical, such that the larger tongue and groove act as a guide to help guide the lid down onto the base when the lid is slightly twisted and therefore misaligned with the base. Before the two smaller tongues begin to engage their respective grooves, the larger tongue begins to engage the larger groove. The larger tongue and groove can therefore act as a cam and cam surface to guide the lid and base together such that the smaller tongues will reliably engage their respective grooves.

Additional features of the container help ensure drop resistance, leak resistance, and stackability. The result is that a container incorporating features described herein is lightweight and reusable, and has been certified as conforming to the American Transport Association (ATA) 300 Category I requirements, and as passing relevant tests specified in the CFR, the United Nationals Recommendations on the Transport of Dangerous Goods—Model Regulations (UN—Orange Book), the International Maritime Dangerous Goods Code (IMDG), the American Society for Testing and Materials (ASTM), and the International Organization for Standardization (ISO), for UN 2795 materials including alkali batteries for automotive and aviation applications.

In one aspect, the invention is of a container body and a lid, one of the body or the lid contain a large ridge and two smaller recess, and the other containing two small ridges and a larger recess, with the larger ridge first engaging the larger recess when the lid is nearly closed to help guide the smaller ridges and recesses into mating alignment. In another aspect, the invention is of a hinged box having at least two significantly differently sized tongue-in-groove gasketed sealing joints, with the larger joint providing structural integrity and the smaller joint providing a redundant seal. In yet another aspect, the invention is of an asymmetrical seal in which a sealing groove is defined by two generally intersecting walls, with the wall that is farther from the hinge having a greater angle with respect to the vertical than the wall that is closer to the hinge.

BRIEF DESCRIPTION OF THE DRAWINGS

Exemplary embodiments of the invention will be further described below with reference to the drawings, in which like numbers refer to like parts, and in which:

FIG. 3 is a fragmentary vertical cross section of the front walls of the container base and lid as the base and lid are almost but not completely closed together;

FIG. 4 is a fragmentary vertical cross section taken along a longitudinal axis of the container, showing part of the front and back walls of the container base and lid when they are closed together;

DETAILED DESCRIPTION OF EXEMPLARY EMBODIMENTS

Figure 1:
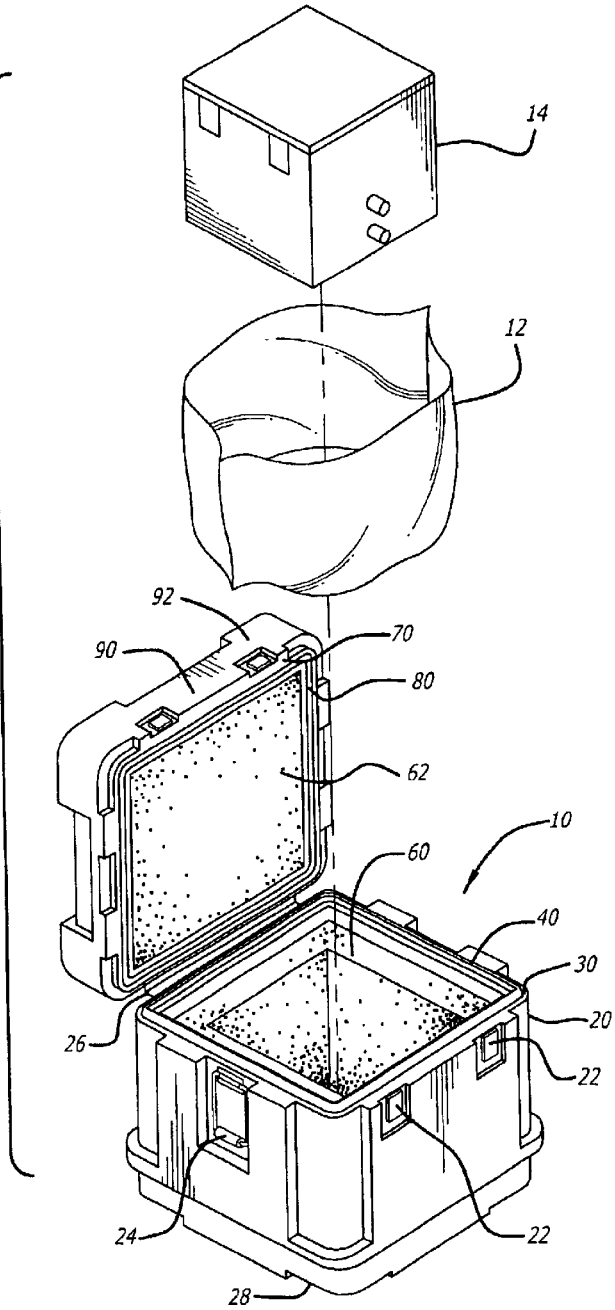
FIG. 1 is an exploded view showing a box and plastic bag according to the present invention, and a battery.
Figure 6:
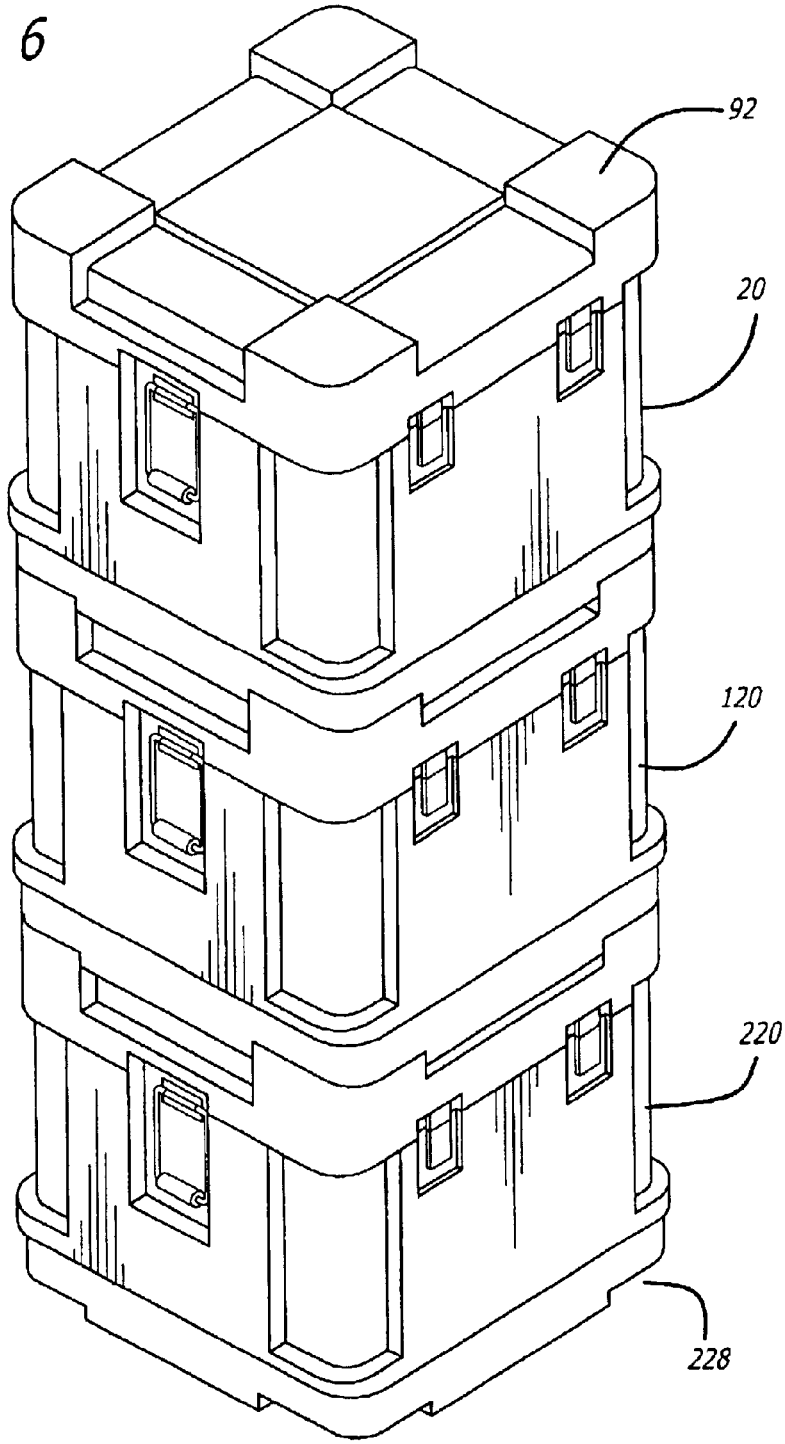
FIG. 6 shows multiple boxes according to the present invention stacked on top of each other.

FIG. 1 is an exploded view showing one exemplary embodiment of the container 10 of the present invention including a bag 12 which is a separate piece, and an object 14 to be stored and/or transported such as a wet cell alkali aviation battery. Bag 12 is a sealable plastic bag which is resistant to corrosive materials such as acid and alkali, and is obtained from Com-Pac International, P.O. Box 2707, 800 Industrial Park Road, Carbondale, Ill. 62901. Container 10 includes a base or body 20 and a lid or cover 90. Base 20 includes latches 22 including the portions of the latches on lid 90, and carrying handles 24 only one of which is shown. One or more hinges 26 rotatably connect base 20 to lid 90 so that the container can be opened and closed by opening and closing the lid down onto the base. Recesses formed into base corners 28 mate with corresponding raised areas 92 on the corners of lid 90 such that the containers can be neatly and relatively securely stacked as shown in FIG. 6. Base 20 and lid 90 may be provided with foam inserts 60 and 62 which define a foam cradle for snugly and securely holding the object 14 to be placed inside the container. Base 20 has a base rim 30, and lid 90 has a lid rim 70.

Figure 2:
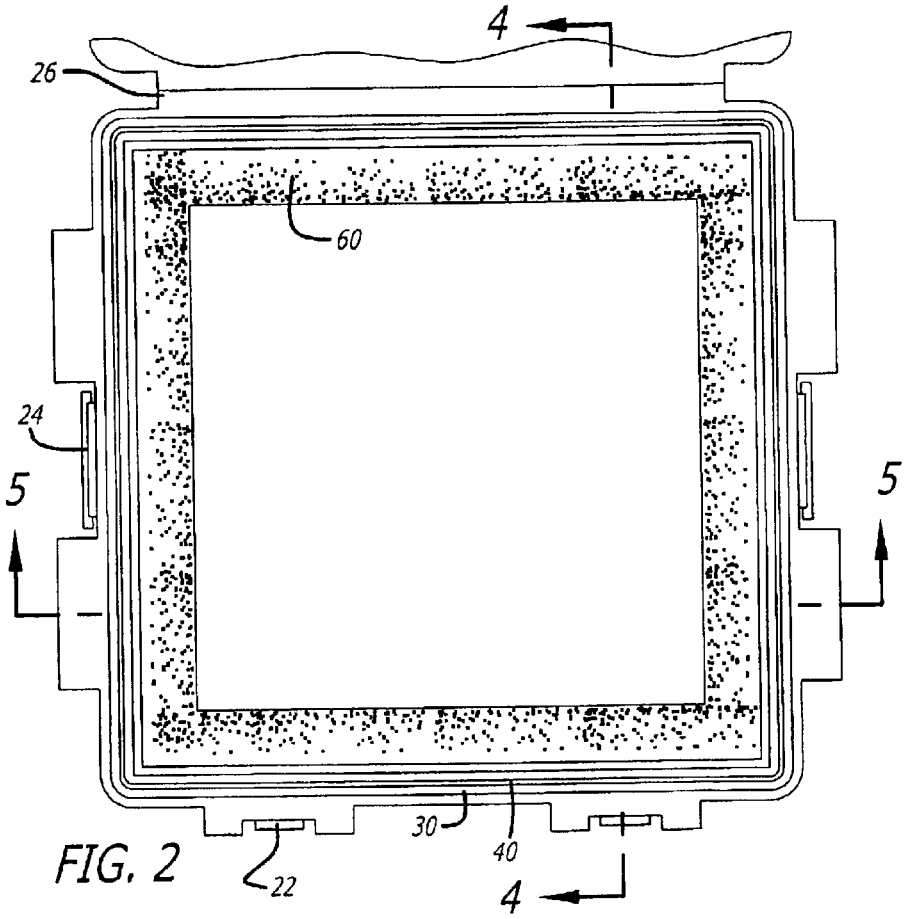
FIG. 2 is a top plan view of the container base, with the lid open and only partially shown.

FIG. 2 is a top plan view showing the base of the container. The rim includes a major ridge 40 and at least one minor recess 30, which will be illustrated and explained in greater detail in connection with additional figures. Hinge 26 and latches 22 are visible.

FIG. 3 shows the details of base rim 30 and lid rim 70 according to a preferred embodiment. Base rim 30 includes generally flat sections 32 and 48, first and second small or minor grooves 34 and 44, and a larger or major ridge or tooth 40 having first and second ridge walls 38 and 42. Within the minor grooves are sealing gaskets 36 and 46. The sealing gaskets can be formed from a corrosive resistant materials such as a commercially available silicone which may be congealed in situ, or the gaskets can be prefabricated gaskets such as commercially available O-ring type gaskets. Similarly, lid rim 70 has flat sections 72 and 84, minor teeth or ridges 74 and 82, a major recess defined by major recess walls 76 and 80, and a sealing gasket 78. The three sets of ridges and recesses form three tongue-in-groove joints, with the center tongue-in-groove joint having a larger tongue and groove than the two smaller tongue-in-groove joints on either side of the larger joint. The three tongue-in-groove gasketed joints provide double redundant sealing to help prevent leakage of any hazardous material such as alkali electrolyte from the battery 14 being carried inside the box. The large central tongue-in-groove joint provides high resistance to shear or twisting of the lid when subjected to loads and stresses such as the container being dropped on a corner from over one meter high, which is one of the tests specified in 49 CFR 178.603. At the same time, if the two smaller tongue-in-groove joints were to be made as large as the central joint, then the base and lid rims of the container would have to be significantly wider, thus requiring more material for the construction of the box and increasing the unusable dead space within the container. Because space and weight are both costly in air transport applications, it is a significant advantage to have an extremely strong lid-to-base joint which requires only a minimum of mating face real estate. In the preferred embodiment, the major central tongue is approximately 1.2 cm high as measured from the mating face, and the two outer minor tongues are approximately 0.3 cm high as measured from the mating face. The mating grooves are of approximately the same depth and shape as the tongues. Thus, the major tongue is approximately four times as high as the minor tongues, and the major groove is approximately four times as deep as the minor grooves. The major tongue height could be reduced with attendant loss of strength but also attendant decrease in the width of the rim. Thus the major tongue could be 25% larger than one or more of the minor tongues, 50% larger, twice as large, three times as large, four times as large, or any number the designer might choose, depending on how strong a joint is required for any particular application, taking into account the environmental stresses to be placed on the container, the strength and elasticity of the material out of which the container is constructed, the weight of the goods to be carried within the container, and other factors that will be apparent to persons familiar with the design of shipping containers. Correspondingly, the major recess or groove could be 25% deeper than the minor grooves, 50% deeper, twice as deep, three times as deep, four times as deep, or any number the designer might choose.

Depending on the application, it is not necessary that the container include three separate tongue-in-groove joints. A container could include only two joints, with one joint being larger than the other. A container could also include only a single deep unsealed or ungasketed joint to provide structural integrity, and a single sealing surface for sealing integrity. The sealing surface could be a single gasketed tongue-in-groove joint or any other sealing surface such as two generally flat rim surfaces with an elastomeric O-ring forming a seal between the two surfaces, with or without a groove being formed in one of the otherwise flat surfaces for positioning and holding the O-ring in place. Similarly, the container could include more than three total joints.

As an additional feature of the present invention, the major tongue or ridge is preferably slightly asymmetric in cross section. Because the tall tongue has to work in a hinged environment, the major tongue-in-groove that is closest to the hinge must have its wall that is farthest from the hinge sufficiently angled away from the vertical so that there is no interference as the lid is being opened and closed. That is, along the major groove that runs along the back side of the rim of the container, the recess wall that is distal from the hinge must form an angle with the container rear wall which shall be called the vertical that is sufficiently large to prevent interference. Because the other wall of the recess, i.e., the wall that is proximal to the hinge, need not be angled as much, the wall that is distal to the hinge forms a greater angle with respect to the vertical than does the wall that is proximal to the hinge.

As shown in FIG. 3, the major ridge is generally defined by two intersecting walls 38 and 42. In the figure, first wall 38 is closest to the front of the container, i.e., the side of the container on which the latches are mounted, and second wall 42 is closest to the back of the container, i.e., the side of the container on which the hinges are mounted. Wall 38 farthest from the hinges is slightly less steep in slope. That is, it defines a somewhat greater angle with respect to the vertical front wall of the container. Similarly, mating surface 76 within the major groove defines a somewhat greater angle with respect to the vertical front wall of the lid than does wall 80 which is closer to the hinges. The asymmetry preferably extends around all four sides of the container, with the wall defining a greater angle with respect to the vertical being disposed: on the front rim, farthest away from the hinges; on the back rim, farthest away from the hinges, and on the side rims, toward the outside of the container. Thus, the asymmetrical cross section of the joints is itself symmetrical when a cross section of the rim is taken along a longitudinal or front-to-back axis, but asymmetrical when a cross section of the rim is taken along a transverse or side-to-side axis. This situation is depicted in FIGS. 4 and 5.

FIG. 4 is a vertical sectional view taken along the longitudinal axis of the container. Walls 38 and 50 have generally the same slope, which is a greater slope with respect to the vertical than the slopes of walls 42 and 52. Thus, the cross section of the rim taken vertically along a longitudinal axis is asymmetric with respect to the central transverse axis of the container. The container includes latch 22 at the front and hinge 26 at the back.

Figure 5:
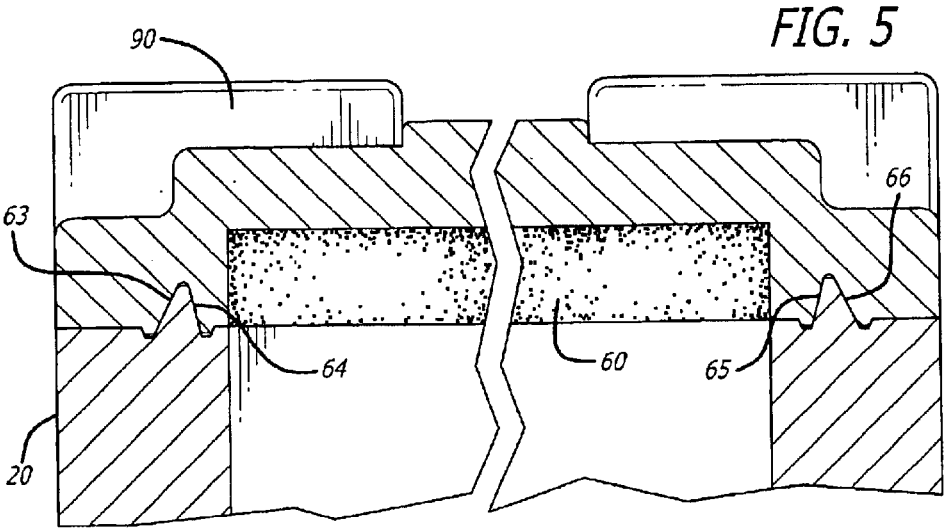
FIG. 5 is a fragmentary vertical cross section taken along a transverse axis of the container, showing parts of two side walls of the container base and the lid when the base and lid are closed together.

FIG. 5 is a vertical sectional view taken along a transverse axis of the container. Walls 63 and 66 have generally the same slope, which is a greater slope with respect to the vertical than the slopes of walls 64 and 65. Thus, the cross section of the rim taken along a transverse axis is symmetric with respect to a longitudinal axis of the container. When the lid is slightly skewed due to original misalignment of the lid on the box, past physical and/or thermal stresses having caused deformation, or the lid simply being twisted by an applied force at the time that the lid is being closed, the differently angled walls of the major ridge help to guide the lid down onto the base into proper mating alignment. As the lid is being lowered but before the minor teeth engage the minor recesses, sloped wall 38 of the major ridge in FIG. 3 can engage sloped wall 76 of the major recess and guide the rim down onto the base. Similarly, if the lid is skewed to the side, sloped walls 63 or 66 in FIG. 5 help guide the lid down into place on the base. Thus, the major ridge not only provides structural integrity against side and corner impacts when the lid is closed and the latches tightened, but also acts as a guide to help ensure proper mating of all of the sealing surfaces onto their respective sealing gaskets.

FIG. 6 illustrates a plurality of containers 20, 120, and 220 according to the present invention stacked together. Raised portions on lid corners 92 mate with corresponding recesses 228 in base corners to make stacks of the containers stable. Thus, the containers are stackable.

As yet a further feature, the fasteners that are used to affix the handles, hinges, and latches to the container base and lid do not create holes into the interior of the container that could allow the container to leak. The holes through the walls of the container are hermetically sealed to prevent such through-hull leakage. In the preferred embodiment this hermitic sealing is accomplished by molding integral to the container internally threaded metal plates or inserts. That is, during the molding process tapped metal plates or inserts are encapsulated by the molten plastic used to make the box, such that when the screws used to hold the handles, hinges, and latches are screwed into the box from the outside, the screws remain hermetically separated from the interior of the box by the layer of plastic which surrounds the threaded plates or inserts. Thus, there is no break in the plastic wall which could allow corrosive chemicals to leak out, or begin corroding the fasteners. At the same time, a strong female part of the fastener is provided which is highly resistant to stripping and is capable of many cycles. If, for example, a handle is damaged in the field, a worker can simply unscrew the screws which hold the handle to the side of the container, remove and discard the damaged handle, and attach the new handle using the same screws, all without breaking the hermetic seal.

The container of the present invention is thus lightweight, capable of carrying materials which might leak corrosive liquids, capable of withstanding severe side and corner impacts, stackable, field serviceable, and reusable and therefore environmentally friendly. It has been certified to pass the Air Transport Association (ATA) 300 Category I requirements. The container has been tested for carrying UN 2795 hazardous materials and certified to pass a number of regulatory and industry standards as listed in Tables 1 and 2 below. To the best of the applicant's knowledge, no other plastic container has ever been produced which is capable of passing those standards.

TABLE 1

| | Regulatory Standards Passed | | |
|---|---|---|---|
| Test | 49 CFR[1] (2000 Edition) | UN[2] (11th Edition) | IMDG[3] (2000 Edition) |
| Drop: | 178.603 | 6.1.5.3 | 6.1.5.3 |
| Stack: | 178.606 | 6.1.5.6 | 6.1.5.6 |
| Vibration: | 178.608 | — | — |

[1]United States Department of Transportation Code of Federal Regulations (CFR) Title 49, Transportation, Parts 100–199
[2]The United Nations Recommendations on the Transport of Dangerous goods - Model Regulations (UN - Orange Book)
[3]International Maritime Dangerous Goods Code (IMDG)

TABLE 2

| Industry Standards Passed | | |
|---|---|---|
| Drop: | ASTM[4] D5276: | Standard Test Method for Drop Test of Loaded Containers by Free Fall |
| | ISO[5] 2248: | Packaging - Complete, Filled Transport Packages - Vertical Impact Test by Dropping |
| Stack: | ASTM D4577: | Standard Test Method for Compression Resistance of a Container Under Constant Load |
| | ISO 2234: | Packaging - Complete, Filled Transport Packages - Stacking Testing Using Static Load |
| Vibration: | ASTM D999: | Standard Test Method for Vibration Testing of Shipping Containers |
| | ISO 2247: | Packaging - Complete, Filled Transport Packages - Vibration Test at Fixed Low Frequency |

[4]American Society for Testing and Materials (ASTM)
[5]International Organization for Standardization (ISO)

It will be appreciated that the term "present invention" as used herein should not be construed to mean that only a single invention having a single essential element or group of elements is presented. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, various types of hinges, latches, and handles can be used; the number, type, relative and absolute sizes, and shape of the seals can be altered; different materials can be used; and the container can be adapted to carry various types of goods. Still further, the larger tongue could be formed on the lid instead of the base as illustrated in the figures, and the smaller tongues could be formed on the base. Further still, the lid could be not hinged to the base, but could be strapped down to the base via cinching latches on multiple sides of the container. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A container suitable for storing and transporting electrical storage batteries containing corrosive liquid, comprising:

a container body and a lid connected thereto by a hinge;

one of said body and said lid including a first mating surface, and the other of said body and said lid including a second mating surface, said first and second mating surfaces mating with each other when said lid is closed onto said body to form a seal therebetween, wherein:

said first mating surface includes a major ridge and two minor recesses disposed on either side of said major ridge;

said second mating surface includes a major recess and two minor ridges disposed on either side of said major recess;

said major ridge being larger than both of said minor ridges; and whereby when said lid is being closed said major ridge first partially engages said major recess and guides said minor ridges into partial engagement with said minor recesses if the lid is skewed, with the major ridge engaging the major recess and the minor ridges engaging the minor recesses when said lid is fully closed onto said body.

2. The container of claim 1 wherein:

said major recess is defined by two unequally angled surfaces in a rearward rim of one of said container lid and said container body.

3. The container of claim 1 wherein:

said major recess is defined by a proximal major recess wall and a distal major recess wall, said proximal major recess wall being disposed closer to said hinge than said distal major recess wall, said distal major recess wall defining a greater angle with respect to vertical when said lid is closed than said proximal major recess wall.

4. The container of claim 1 wherein:

said first mating surface further includes generally flat areas adjacent to each of said minor recesses and distal from said major recess; and said second mating surface further includes generally flat areas adjacent to each of said minor ridges and distal from said major recess.

5. A storage container suitable for containing hazardous materials comprising:

a container body; and a lid connected to said body by a hinge, said body and said lid each having four sides;

wherein a rim on one of said body and said lid defines a first rim, and a rim on the other of said body and said lid defines a second rim;

said first rim includes:

first and second grooves for receiving corresponding first and second ridges on said second rim;

first and second sealing gaskets disposed in said first and second grooves, respectively; and an angled portion between said grooves, said angled portion being capable of at least partially engaging a corresponding guiding surface on said second rim when said lid is misaligned with said base and is partially closed but before said ridges engage said grooves, said angled portion and said guiding surface cooperating together to guide said lid and said body together as said lid is closed so that said ridges properly align with said grooves and mate therewith when the lid is fully closed.

6. The container of claim 5 wherein:

said guiding surface is defined by a third groove which extends around four sides of said second rim;

said angled portion is defined by a third ridge which extends around four sides of said first rim; and said third ridge has an asymmetrical first cross section at a side of said first rim proximal to said hinge.

7. The container of claim 6 wherein said third ridge is at least 50% taller than each of said first and second ridges.

8. The container of claim 6 wherein said third ridge is at least twice as tall as each of said first and second ridges.

9. The container of claim 6 wherein said third ridge is approximately four times as tall as each of said first and second ridges.

10. The container of claim 7 wherein:

said ridges and said grooves together define three tongue-in-groove sealing joints which extend around mating rims of said container body and said lid, said sealing joints having substantially identical asymmetrical cross sections at a front and a back of a hinged opening of the container, both of said cross sections being oriented substantially identically along a longitudinal axis of said container.

11. The container according to claim 5 wherein:

said container body and said lid are made of cross-linked polyethylene;

each of said first and second grooves holds a respective sealing gasket;

any fastener holes through any walls of said container body and said lid are hermitically sealed.

12. A container comprising:

a box and a lid;

a hinge connecting said lid to said box; and two tongue-in-groove joints formed at the interface between said lid and said box, said tongue-in-groove joints including first and second tongues and respective first and second grooves, the tongues fitting into the respective grooves when the lid is closed down onto the box;

wherein the first tongue is at least 50% taller than the second tongue.

13. The container according to claim 12 wherein said two tongue-in-groove joints taken together have an asymmetric cross section taken along a longitudinal axis of said container.

14. The container according to claim 12 wherein said two tongue-in-groove joints taken together have a first asymmetric cross section taken closest to said hinge along a longitudinal axis of said container, and have a second asymmetric cross section taken farthest from said hinge along a longitudinal axis of said container, said first and second asymmetric cross sections being oriented in substantially the same direction relative to said hinge.

15. A container comprising:

first and second box portions hinged together to define a box when closed together;

said first box portion having a first rim and said second box portion having a second rim, said rims abutting each other when said container is closed; and wherein:

said rims together include at least first and second ridges and corresponding first and second grooves for receiving said ridges;

the two ridges are generally oppositely oriented; and said first ridge is larger than the second ridge.

16. The container according to claim 15 wherein said first ridge is at least twice as tall as the second ridge.

17. The container according to claim 16 wherein said first ridge has an asymmetrical cross section.

18. The container according to claim 15 wherein:

said rims include a third ridge of generally the same height as the second ridge.

19. The container according to claim 18 wherein said second and third ridges are disposed on opposite sides of said first ridge when said container is closed.

20. The container according to claim 15 wherein a cross section of said first rim taken along a longitudinal axis of said box includes, in order beginning closest to the hinge:

a first generally flat section;

said second groove;

said first ridge;

a third groove; and a second generally flat section.

21. The container according to claim 20 wherein said second and third grooves are approximately the same depth.

22. The container according to claim 15 wherein:

said first ridge extends around a periphery of said first rim, said first ridge having four sides comprising a rear ridge portion nearest to said hinge, a front ridge portion farthest from said hinge, and two side ridge portions connecting the back ridge portion to the front ridge portion;

a cross section of said first ridge taken along a transverse axis of said container is symmetrical about a longitudinal axis of said container; and a cross section of said first ridge taken along a longitudinal axis of said container is asymmetrical about a traverse axis of said container.

23. The container of claim 15 further comprising:

a plurality of latches for latching said lid onto said container body; and foam inserts affixed to interior surfaces of said container body such that said container body receives and snugly holds an electrical storage battery of the wet cell type;

wherein a top of said lid and a bottom of said container body have respectively shaped surfaces so that a plurality of said containers is stackable.

24. The container of claim 15 further comprising, in combination with said container, a sealable corrosive resistant bag for holding corrosive liquid containing objects within said container.

* * * * *